US007300306B2

(12) United States Patent
Le et al.

(10) Patent No.: US 7,300,306 B2
(45) Date of Patent: Nov. 27, 2007

(54) DATA STORAGE DEVICE WITH SELF-MATING HOST CONNECTOR THAT IS INSERTABLE INTO A RECEPTACLE FORMED IN A HOUSING OF THE DEVICE

(75) Inventors: Trung V. Le, White Bear Township, MN (US); Max Burton, Portland, OR (US); Cyan Godfrey, New York, NY (US); Mark Prommel, New York, NY (US); Richard Whitehall, New York, NY (US)

(73) Assignee: Imation Corp., Oakdale, MN (US)

( * ) Notice: Subject to any disclaimer, the term of this patent is extended or adjusted under 35 U.S.C. 154(b) by 315 days.

(21) Appl. No.: 11/123,800

(22) Filed: May 6, 2005

(65) Prior Publication Data

US 2006/0252305 A1 Nov. 9, 2006

(51) Int. Cl.
*H01R 13/60* (2006.01)

(52) U.S. Cl. ..... 439/502; 439/528

(58) Field of Classification Search ..... 439/528, 439/135, 501, 502; D14/356; 710/74
See application file for complete search history.

(56) References Cited

U.S. PATENT DOCUMENTS

| | | | | |
|---|---|---|---|---|
| 6,292,863 | B1 | 9/2001 | Terasaki et al. | |
| 6,295,031 | B1 | 9/2001 | Wallace et al. | |
| 6,386,908 | B2 * | 5/2002 | Kato et al. | 439/528 |
| 6,428,348 | B1 | 8/2002 | Bean | |
| 6,705,890 | B2 * | 3/2004 | Kitou et al. | 439/528 |
| 6,705,891 | B1 | 3/2004 | Lin | |
| 6,790,077 | B1 * | 9/2004 | Chen | 439/502 |
| 6,795,327 | B2 | 9/2004 | Deng et al. | |
| 6,921,284 | B2 * | 7/2005 | Sirichai et al. | 439/490 |
| D537,818 | S * | 3/2007 | Burton et al. | D14/356 |
| 2003/0224637 | A1 | 12/2003 | Ling | |
| 2004/0139279 | A1 | 7/2004 | Hoogerdijk | |
| 2005/0112938 | A1 | 5/2005 | Liow et al. | |
| 2006/0047880 | A1 * | 3/2006 | Lindblom et al. | 710/305 |
| 2006/0198177 | A1 * | 9/2006 | Chang et al. | 365/52 |
| 2007/0058295 | A1 * | 3/2007 | Lasser | 360/131 |

FOREIGN PATENT DOCUMENTS

| | | |
|---|---|---|
| WO | WO 01/61692 | 8/2001 |

* cited by examiner

*Primary Examiner*—Neil Abrams
(74) *Attorney, Agent, or Firm*—Eric D. Levinson

(57) ABSTRACT

The invention is directed to a data storage device that includes a host connector to facilitate attachment to a host computer so that the host computer can access one or more storage elements within the device. The data storage device includes a flexible member to mechanically and electrically couple the host connector of the device to a housing that holds the storage elements. The housing may comprise a receptacle for insertion of the host connector when the device is not coupled to a host computer. The flexible member may define a length and a flexibility sufficient to allow the host connector to be inserted into the receptacle in the housing. When the host connector is inserted into the receptacle in the housing, the data storage device forms a loop, allowing the device to be attached to items or objects or possibly worn as jewelry.

15 Claims, 6 Drawing Sheets

DATA STORAGE DEVICE WITH SELF-MATING HOST CONNECTOR THAT IS INSERTABLE INTO A RECEPTACLE FORMED IN A HOUSING OF THE DEVICE

TECHNICAL FIELD

The invention relates to compact data storage devices.

BACKGROUND

A wide variety of data storage media exist for transferring data from one device to another device. The data storage media may allow users to easily transport data between various devices, computers, and locations. Compact data storage media are particularly desirable for individual users, and are commonly used for the storage and transport of information. A compact data storage medium includes one or more storage elements that store the information within the medium. A connector may be formed on the data storage medium to allow electrical access to the storage elements within the data storage medium so that information can be stored in the storage elements or accessed from the storage elements via electrical signals.

One of the most popular types of storage elements used in compact data storage media is a flash memory drive. A flash memory drive includes an internal, high-speed solid-state memory capable of persistently storing data without the application of power. A flash memory drive is compact, easy to use, and has no moving parts. Another very popular type of storage element is a micro hard disk drive. Micro hard disk drives are generally miniature versions of conventional hard drives, and include a rotating magnetic hard disk and a transducer head to read and write data to the disk. Cost and performance tradeoffs generally exist between flash memory drives and micro hard drives, although both types of storage elements are generally acceptable for use in compact data storage media. Moreover, many other types of storage elements may also be used in compact data storage devices, such as electrically-erasable-programmable-read-only-memory (EEPROM), non-volatile random-access-memory (NVRAM), and other non-volatile or volatile memory types, such as synchronous dynamic random-access-memory (SDRAM), with battery backup.

Some compact data storage media include a specialized connector for coupling directly to a host computer. For example, a host connector may allow the data storage medium to be coupled directly to a host computer interface of a host computer, such as a Universal Serial Bus (USB) interface, in order to allow data transfer between the storage devices of the host computer and the storage elements of the data storage medium. The use of host connectors on compact data storage media can eliminate the need for specialized readers or specialized media drives designed solely for the data storage media.

Examples of host connectors that may be used for compact data storage media include a personal computer memory card international association (PCMCIA) connector including a 16 bit standard PC Card interface and a 32 bit standard CardBus interface, a Universal Serial Bus (USB) connector, a Universal Serial Bus 2 (USB2) connector, an IEEE 1394 FireWire connector, a Small Computer System Interface (SCSI) connector, an Advance Technology Attachment (ATA) connector, a serial ATA connector, an Integrated Device Electronic (IDE) connector, an Enhanced Integrated Device Electronic (EIDE) connector, a Peripheral Component Interconnect (PCI) connector, a PCI Express connector and a conventional serial or parallel interface connector.

SUMMARY

In general, the invention is directed to a data storage device that includes a host connector to facilitate attachment of the data storage device to a host computer so that the host computer can access one or more storage elements within the device. The host connector, for example, may comprise a Universal Serial Bus (USB) connector that can be inserted into a USB port of the host computer. In accordance with the invention, the data storage device includes a flexible member to mechanically and electrically couple the host connector of the device to a housing that holds the storage elements. Moreover, the housing may comprise a receptacle for insertion of the host connector when the data storage device is not coupled to a host computer. The flexible member may define a length and a flexibility sufficient to allow the host connector to be inserted into the receptacle in the housing. When the host connector is inserted into the housing, the data storage device defines a loop, which allows the device to be attached to various items or articles when the device is not in use.

In one embodiment, the invention is directed to a data storage device comprising a housing formed with a receptacle; one or more storage elements within the housing; a controller within the housing to control access to the one or more storage elements; a host connector to facilitate attachment of the data storage device to a host computer so that the host computer can access the one or more storage elements, the host connector defining a size relative to the host connector such that the host connector can fit into the receptacle in the housing; a flexible member to mechanically couple the host connector to the housing, wherein the flexible member defines a length and a flexibility such that the host connector can be inserted into the receptacle in the housing, wherein the flexible member extends from a top surface of the housing and the receptacle is formed in the top surface such that the data storage device defines a padlock-like form factor; and a locking mechanism to lock the host connector into the receptacle upon insertion of the host connector into the receptacle.

In another embodiment, the invention is directed to a data storage device comprising a housing formed with a receptacle; one or more storage elements within the housing; a host connector to facilitate attachment of the data storage device to a host computer so that the host computer can access the one or more storage elements, the host connector defining a size relative to the host connector such that the host connector can fit into the receptacle in the housing; and a flexible member to mechanically couple the host connector to the housing, wherein the flexible member defines a length and a flexibility sufficient to allow the host connector to be inserted into the receptacle in the housing.

The invention may be capable of providing one or more advantages. For example, the invention may define a compact data storage device having a very useful form factor that can be worn or attached to articles when not in use. In some embodiments, the device assumes a padlock-like form factor when the host connector is inserted into the receptacle. In other embodiments, the device assumes a loop-shape when the host connector is inserted into the receptacle and may be worn as a bracelet or necklace. Numerous other advantageous features are also described below, including locking mechanisms to secure the host connector within the receptacle of the housing of the device, light emitting diodes for illumination of the device, guides to ensure proper placement of the host connector within the receptacle of the housing, spring elements to provide spring loaded biasing of the host connector locked within the receptacle, and many other useful features.

The details of one or more embodiments of the invention are set forth in the accompanying drawings and the description below. Other features, objects, and advantages of the invention will be apparent from the description and drawings, and from the claims.

DETAILED DESCRIPTION

The invention is directed to a data storage device that includes a host connector to facilitate attachment of the data storage device to a host computer so that the host computer can access one or more storage elements within the device. The data storage device includes a flexible member to mechanically and electrically couple the host connector of the device to a housing that holds the storage elements. The housing may comprise a receptacle for insertion of the host connector when the device is not coupled to a host computer. The flexible member may define a length and a flexibility sufficient to allow the host connector to be inserted into the receptacle in the housing. In some embodiments, the device assumes a padlock-like form factor when the host connector is inserted into the receptacle. In other embodiments, the device assumes a loop-shape when the host connector is inserted into the receptacle and may be worn as a bracelet or necklace.

Figure 1A:
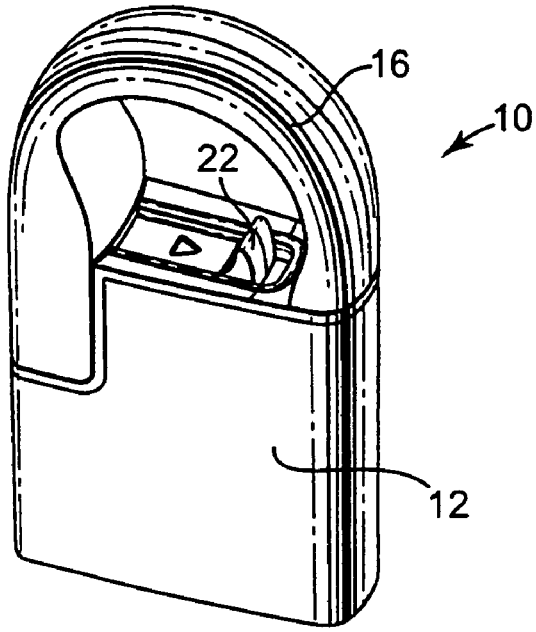
FIGS. 1A and 1B are perspective views of an exemplary data storage device according to an embodiment of the invention.
Figure 1B:
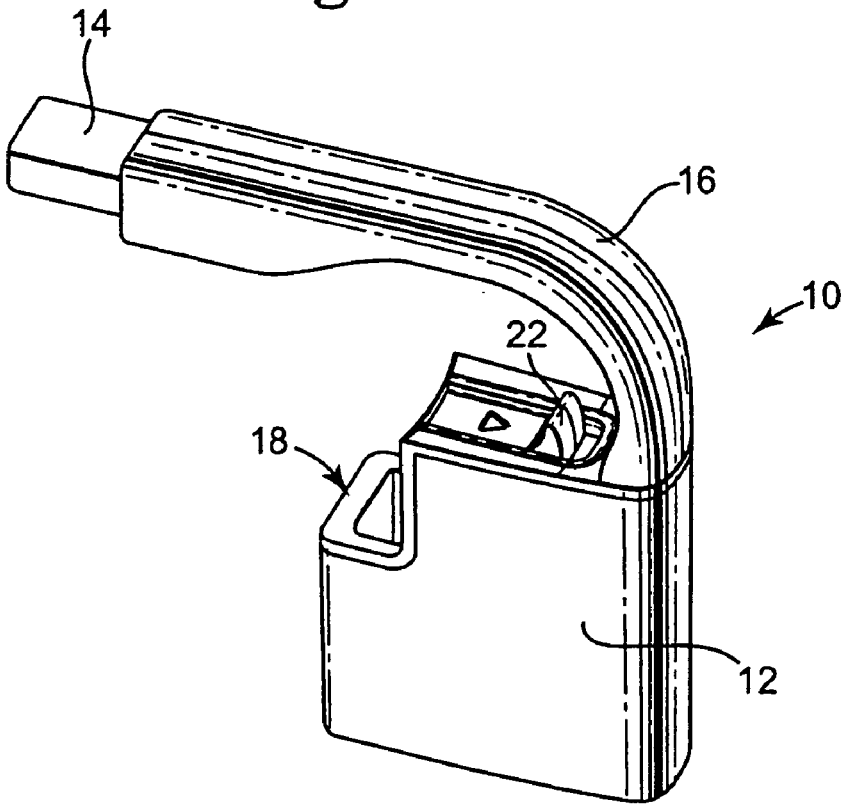

FIGS. 1A and 1B are perspective views of an exemplary data storage device 10 according to an embodiment of the invention. Data storage device 10 includes a housing 12 that houses various electrical components of the device including one or more storage elements such as one or more micro hard drives or one or more Flash memory drives. Data storage device 10 also includes a host connector 14 to facilitate attachment of data storage device 10 to a host computer so that the host computer can access the one or more storage elements within housing 12. A flexible member 16 mechanically and electrically couples host connector 14 to housing 12.

Housing 12 defines a receptacle 18 sized to correspond to host connector 14. In particular, host connector 14 mates with receptacle 18 when host connector is not in use and not coupled to a host computer. In this manner, receptacle 18 defines a convenient docking location of host connector 14 when not in use to protect host connector 14 from damage. In general, host connector 14 and receptacle 18 are sized such that host connector 14 can fit into the receptacle 18.

As noted above, flexible member 16 mechanically and electrically couples host connector 14 to housing 12. Flexible member 16 defines a length and a flexibility sufficient to allow host connector 14 to be inserted into receptacle 18 in housing 12. When host connector 14 is inserted in receptacle 18, data storage device 10 assumes a padlock-like form factor. This design is highly advantageous as it allows for easy attachment of device 10 to various articles or items.

A locking mechanism 22 can secure host connector 14 within receptacle 18 upon insertion. Locking mechanism 22 may be located on a top surface of housing 12 between receptacle 18 and a mechanical junction of flexible member 16 and housing 12. This is a useful location for locking mechanism 22 to avoid accidental actuation and accidental unlocking by a user. Other locations of locking mechanism 22, however, might alternatively be used. Locking mechanism 22 may comprise a spring-loaded element that latches into a small depression formed in flexible member 16 upon insertion of host connector 14 into receptacle 18. The small depression in flexible member 16 is shown as item 28 in FIG. 3.

Host connector 14 may comprise a Universal Serial Bus (USB) connector that can be inserted into a USB port of the host computer, or may comprise a wide variety of other connector types. In any case, host connector 14 defines a size relative to receptacle 18 that allows host connector 14 to fit into receptacle 18. By way of example, host connector 14 may conform to one of the following standards: a personal computer memory card international association (PCMCIA) standard, a PC Card standard, a CardBus standard, a Universal Serial Bus (USB) standard, a Universal Serial Bus 2 (USB2) standard, an IEEE 1394 FireWire standard, a Small Computer System Interface (SCSI) standard, an Advance Technology Attachment (ATA) standard, a serial ATA standard, a Peripheral Component Interconnect (PCI) standard, and a PCI Express standard.

Figure 2:
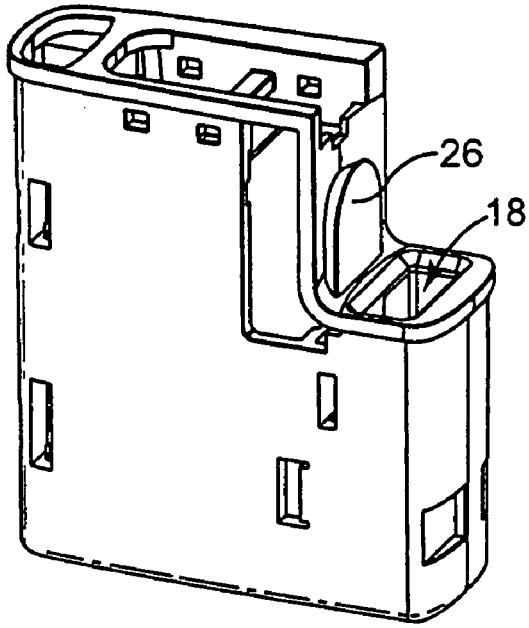
FIG. 2 is a perspective schematic diagram of an exemplary molded plastic interior of the housing of the data storage device illustrated in FIG. 1.

Housing 12 may comprise any of a wide variety of materials. In the illustrated example, housing 12 comprises a molded plastic interior with an aluminum cover for aesthetic purposes and added rigidity. FIG. 2 is a perspective schematic diagram of an exemplary molded plastic interior of housing 12. As shown, receptacle 18 is formed into the molded plastic. In addition, the molded plastic is designed to house the storage elements and to receive the locking mechanism 22 and the flexible member 16 (locking mechanism 22 and flexible member 16 are not shown in FIG. 2). The molded plastic of housing 12 may comprise several molded plastic components that fit together to encase the various other components of device 10.

Figure 3:
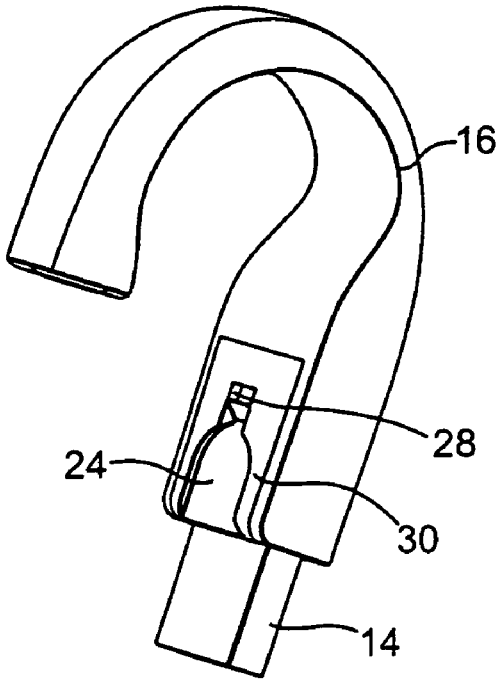
FIG. 3 is a perspective schematic diagram of an exemplary host connector and flexible member of the data storage device illustrated in FIG. 1.

FIG. 3 is a perspective schematic diagram of an exemplary host connector 14 and flexible member 16. In this example, host connector 14 comprises a USB connector with an electrical shield. Flexible member 16 comprises flexible rubber or soft plastic that can be extended to straighten member 16 completely. In addition, flexible member 16 comprises a first guide element 24 formed in proximity to host connector 14. A second guide element 26 (shown in FIG. 2) may be formed on housing 12 in proximity to receptacle 18. The first and second guide elements 24 and 26 interlock to guide host connector 14 into receptacle 18. First guide element 24, as well as the small depression 28 that interacts with locking mechanism 22, may be formed in a rigid portion 30 of flexible member 16. Rigid portion 30 may surround host connector 14 and may be partially encased by the flexible major portion of flexible member 16. The exposed face of rigid portion 30 includes first guide element 24 and the small depression 28 described above.

Figure 4:
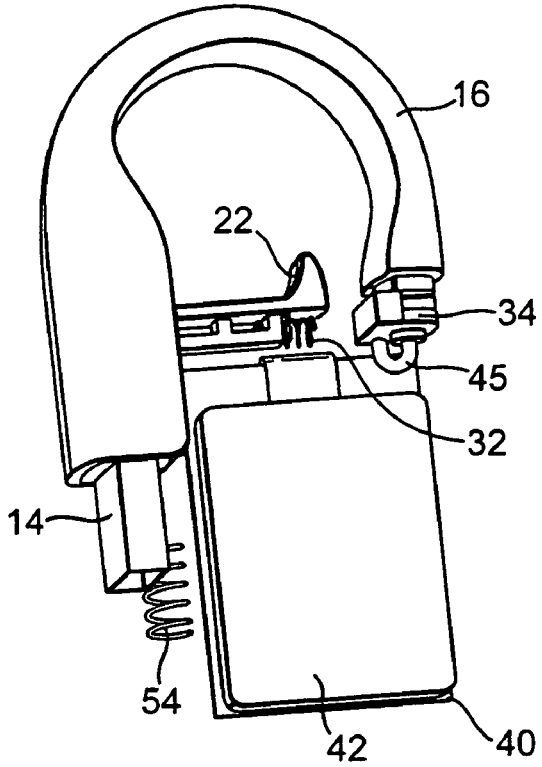
FIGS. 4-6 are partial assembly views of the internal components of the data storage device illustrated in FIG. 1.

FIG. 4 is a partial assembly view of data storage device 10 without housing 12. As shown, locking mechanism 22 interacts with a spring element 32 positioned within the housing (not shown). Again, locking mechanism 22 locks host connector 14 within the receptacle of housing 12 (not shown in FIG. 4) by mating with a small depression formed in flexible member 16. A mechanical element 34, such as a grommet, secures flexible member 16 to the housing. An electrical connector 45 feeds through flexible member 16 to electrically couple host connector 14 to circuit board 40.

Figure 5:
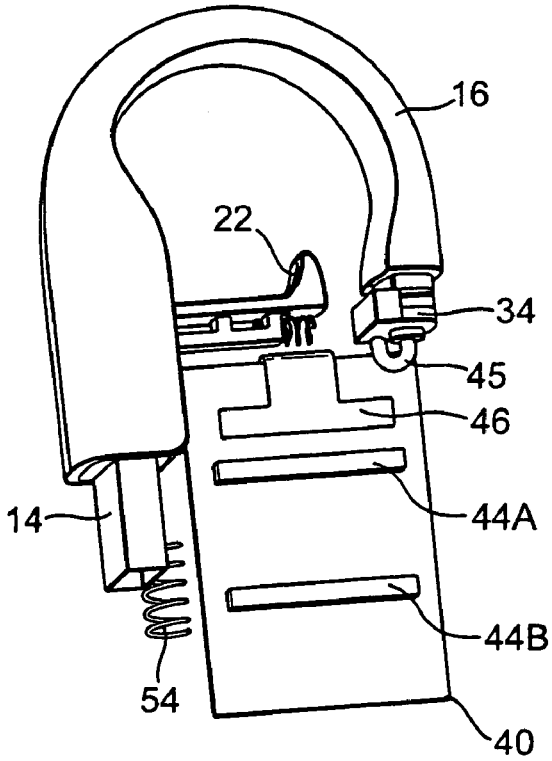

Circuit board 40 is housed within housing 12 (not shown in FIG. 4) to hold the various electrical components of device 10, such as the data storage elements and a controller. In this example, the data storage elements comprise a micro hard drive 42 mounted on circuit board 40. FIG. 5 is another partial assembly view of data storage device 10 with micro hard drive 42 removed. As shown, shock absorbing materials 44A, 44B help absorb any shocks that may damage micro hard drive 42. A flex interface cable 46 electrically connects micro hard drive 42 to circuit board 40 via a hard drive connector (not shown in FIG. 5).

Figure 6:
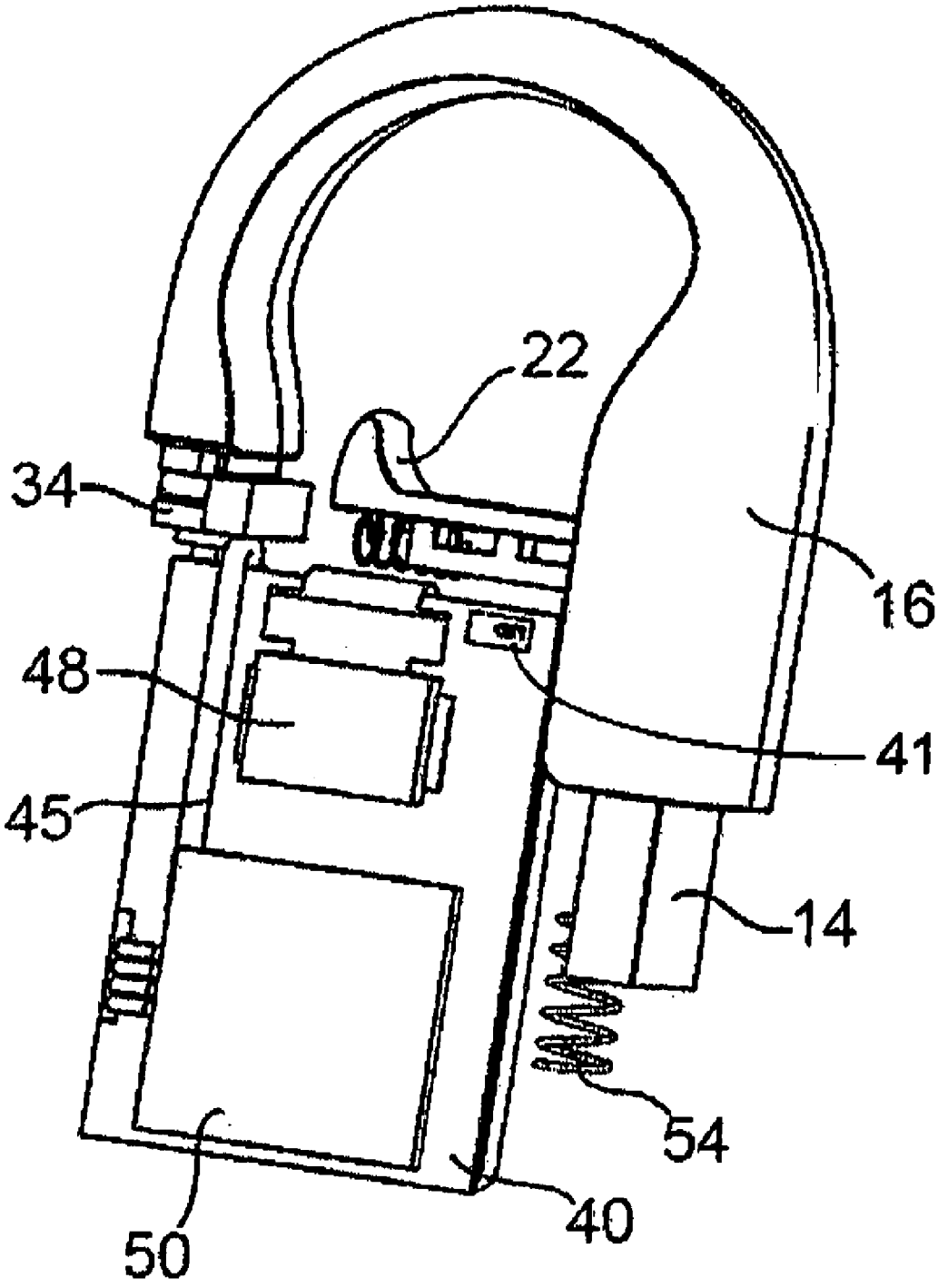

FIG. 6 is partial assembly view of the back side of data storage device 10 without housing 12. This view illustrates how flex interface cable 46 extends to both sides of circuit board 40. Flex interface cable 46 connects to hard drive connector 48, which electrically couples micro hard drive 42 to circuit board 40.

Controller 50 is also shown in FIG. 6, and is electrically coupled to circuit board 40. Controller 50 comprises an integrated circuit designed to control micro hard drive 42 and to communicate with a host computer through the flexible member 16 and host connector 14. In particular, controller 50 controls read and write operations that facilitate data storage and retrieval to and from micro hard drive 42. Electrical connector 45 electrically couples host connector 14 to circuit board 40. Controllers suitable to control micro hard drives or other storage elements are commercially available from a number of vendors.

Spring element 54 is used to bias against host connector 14 when host connector 14 is inserted and locked within receptacle 18 formed in housing 12. In this manner, when locking mechanism 22 is actuated to release host connector 14 from receptacle 18, spring element 54 forces host connector 14 out of receptacle 18. Spring element 54 also provides a biasing resistance force during insertion of host connector 14 into receptacle 18.

If desired, a light emitting diode (LED) 41 or other semiconductor light source may also be provided an circuit board 40. In that case, light emitting diode 41 maybe used to illuminate a portion of housing 12. For example, the portion of housing 12 surrounding locking mechanism 22 may comprise a translucent or partially translucent material that can be illuminated by light emitting diode 41 to provide a desirable lighting effect around locking mechanism 22. Alternatively, the entirety of housing 12 may comprise a translucent or partially translucent material that can be illuminated by a light guide. In yet another example, flexible member 16 may be made of translucent or partially translucent material that will glow with the use of light emitting diode 41 and/or a light guide.

Figure 7:
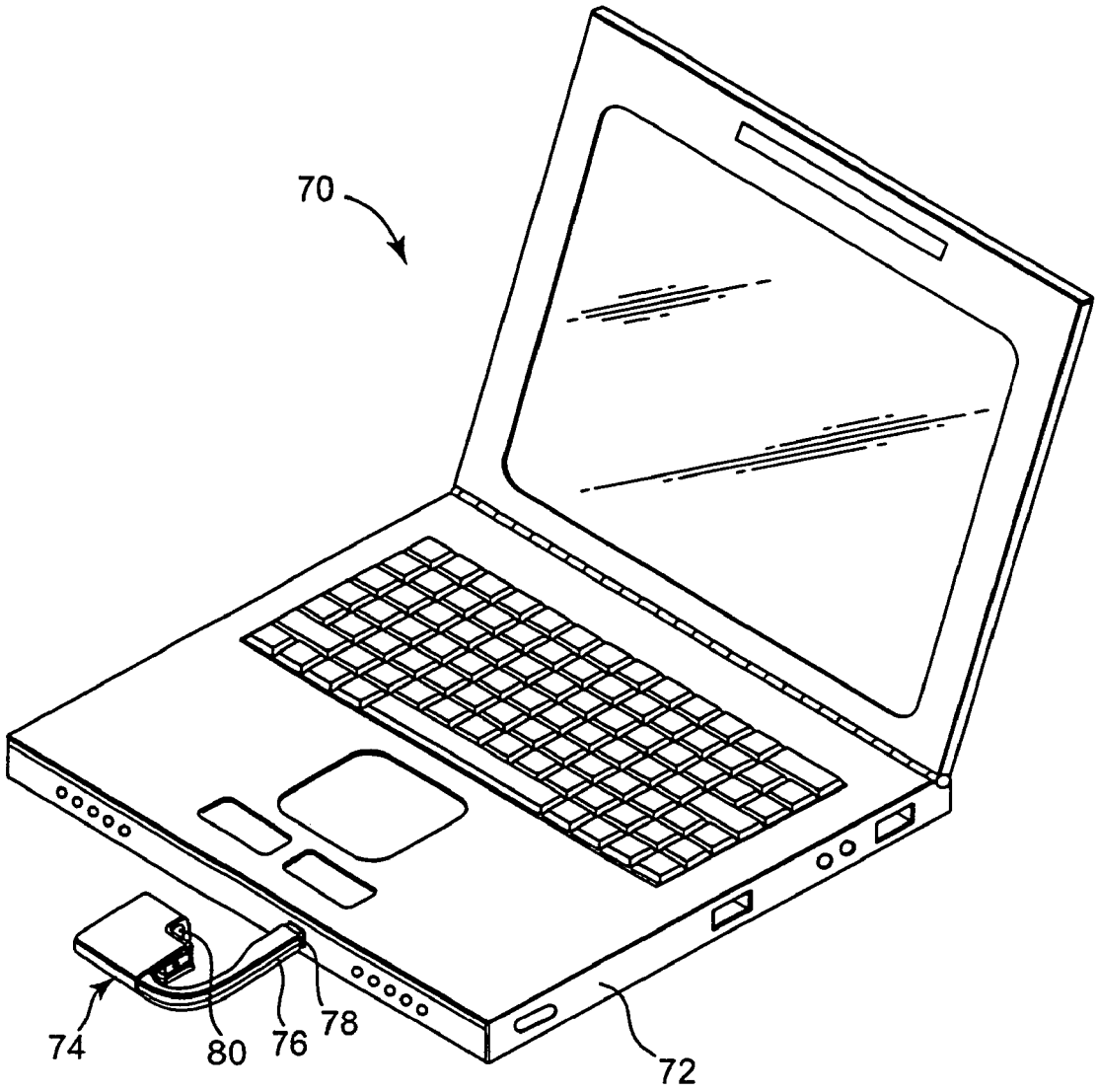
FIG. 7 illustrates a system comprising a host computer and a data storage device according to an embodiment of the invention.

FIG. 7 illustrates a system 70 comprising a host computer 72 (in this example, a laptop computer) and a data storage device 74 according to an embodiment of the invention. As shown in FIG. 7, host connector 76 of data storage device 74 is inserted into a host port 78 of host computer 72 to facilitate information transfer between host computer 72 and data storage device 70. When not in use, host connector 76 can be inserted into receptacle 80 formed in the housing of device 74.

Figure 8:
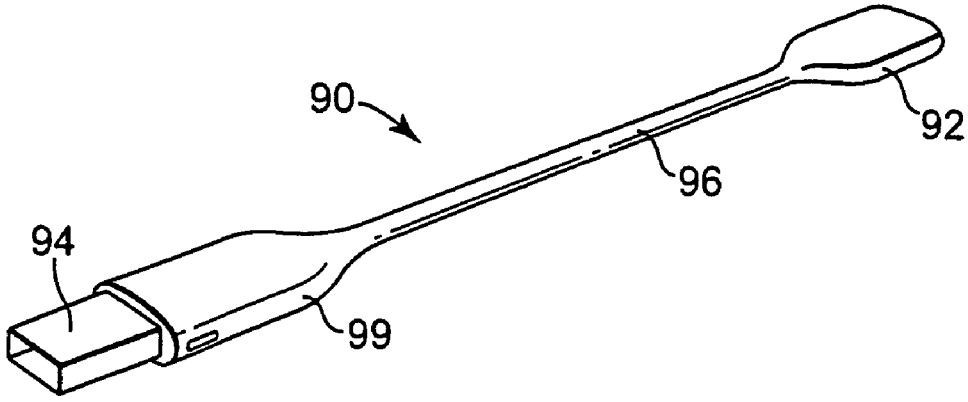
FIGS. 8 and 9 are perspective views of another data storage device according to an embodiment of the invention.
Figure 9:
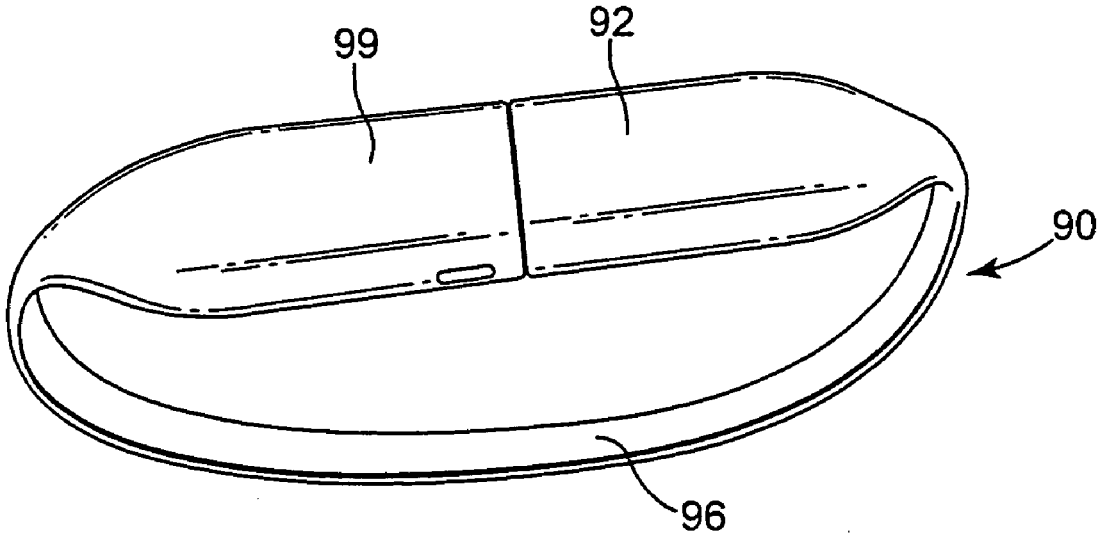

FIGS. 8 and 9 illustrate a data storage device 90 according to another embodiment of the invention. Like data storage device 10, data storage device 90 includes a housing 92 formed with a receptacle. One or more storage elements may be housed within housing 92. A host connector 94 facilitates attachment of data storage device 90 to a host computer so that the host computer can access the one or more storage elements. The host connector 94 defines a size relative to the receptacle such that the host connector can fit into the receptacle in the housing as shown in FIG. 8. In this case, data storage device 90 forms a loop-shape. Data storage device 90 may be attached to various articles or objects, such as clothing or any personal article, or may be worn as a bracelet or necklace.

A flexible member 96 extends between housing 92 to mechanically and electrically couple host connector 94 to housing 92. Accordingly, flexible member 96 defines a length and a flexibility sufficient to allow host connector 94 to be inserted into the receptacle in housing 92. Portion 99 of data storage device 90 may define a size and shape similar to housing 92. In the embodiment of FIGS. 8 and 9, housing 92 may be described as a first housing portion and portion 99 may be described as a second housing portion. The similar shapes and sizes of housing 92 and portion 99 provides for a desirable aesthetic effect and an ergonomic balance if the device is to be worn by a user.

Moreover, in some embodiments, the internal electronics including the data storage elements may be separated into portion 99 and housing 92. Since these respective portions of data storage device 90 are electrically coupled via flexible member 96, the electronics can be housed in either side or distributed between the sides. This may also allow the device to be more compact.

As yet another possible feature for the data storage devices described herein, the receptacle formed in the housing to receive the host connector may be active or passive. In other words, the receptacle in the housing (e.g., receptacle 18 if housing 12 of device 10) may be an electrically inactive docking port, or may be an electrical port that can interface with host connectors of other devices.

Referring to FIG. 7, for example, when host connector 76 is coupled to host port 78 of device 72, receptacle 80 may receive a host connector of another device (i.e., another data storage device or any device that utilizes a similar host interface). In this case, device 72 may supply power to data storage device 74 and may also supply power to the other device coupled to device 74. The controller of data storage device 74 may be programmed with hub functionality to allow other devices to be "daisy chained" to host computer 72 through device 74. Co-pending and commonly assigned application Ser. No. 10/928,488, filed Aug. 27, 2004, describes more details of this feature and is hereby incorporated herein by reference in its entirety.

The data storage device 10 may also be equipped with a security mechanism which provides that flexible member 16 is locked into housing 12 unless the user has the combination to disengage the flexible member from the housing. This feature would preferably be present on housing 12 and could take the form of a combination lock or biometric mechanism, such as a fingerprint scanner.

Various embodiments of the invention have been described. Nevertheless, various modifications may be made without departing from the scope of the invention. These and other embodiments are within the scope of the following claims.

The invention claimed is:

1. A data storage device comprising:

a housing formed with a receptacle;

one or more storage elements within the housing;

a host connector to facilitate attachment of the data storage device to a host computer so that the host computer can access the one or more storage elements, the host connector defining a size relative to the receptacle such that the host connector can fit into the receptacle in the housing;

a flexible member to mechanically couple the host connector to the housing, wherein the flexible member defines a length and a flexibility sufficient to allow the host connector to be inserted into the receptacle in the housing, wherein the flexible member extends from a top surface of the housing and the receptacle is formed in the top surface such that the data storage device defines a padlock-like form factor; and a locking mechanism to lock the host connector into the receptacle upon insertion of the host connector into the receptacle, wherein the locking mechanism is located between the receptacle and a mechanical junction of the flexible member and the housing.

2. The data storage medium of claim 1, wherein the one or more storage elements comprise one or more micro hard drives.

3. The data storage medium of claim 1, wherein the one or more storage elements comprise one or more flash memory drives.

4. The data storage medium of claim 1, further comprising a first guide element formed on the flexible member in proximity to the connector and a second guide element formed on the housing in proximity to the receptacle, wherein the first and second guide elements interlock to guide the connector into the receptacle.

5. The data storage device of claim 1, further comprising a controller within the housing to control information storage to the one or more storage elements.

6. The data storage device of claim 1, wherein the host connector conforms to a standard from the following group of standards: a personal computer memory card international association (PCMCIA) standard, a PC Card standard, a CardBus standard, a Universal Serial Bus (USB) standard, a Universal Serial Bus 2 (USB2) standard, an IEEE 1394 FireWire standard, a Small Computer System Interface (SCSI) standard, an Advance Technology Attachment (ATA) standard, a serial ATA standard, a Peripheral Component Interconnect (PCI) standard and a PCI Express standard.

7. The data storage device of claim 1, wherein the host connector conforms to a Universal Serial Bus (USB) standard.

8. The data storage medium of claim 1, further comprising a light emitting diode within the housing to illuminate at least a portion of the housing, the portion of the housing illuminated by the light emitting diode being at least partially translucent.

9. A data storage device comprising:

a housing formed with a receptacle;

one or more storage elements within the housing;

a host connector to facilitate attachment of the data storage device to a host computer so that the host computer can access the one or more storage elements, the host connector defining a size relative to the receptacle such that the host connector can fit into the receptacle in the housing;

a flexible member to mechanically couple the host connector to the housing, wherein the flexible member defines a length and a flexibility sufficient to allow the host connector to be inserted into the receptacle in the housing;

a locking mechanism to lock the host connector into the receptacle upon insertion of the host connector into the receptacle; and a spring element to provide a bias force against the host connector to force the host connector out of the receptacle when the locking mechanism is released.

10. A data storage device comprising:

a housing formed with a receptacle;

one or more storage elements within the housing;

a host connector to facilitate attachment of the data storage device to a host computer so that the host computer can access the one or more storage elements, the host connector defining a size relative to the receptacle such that the host connector can fit into the receptacle in the housing;

a flexible member to mechanically couple the host connector to the housing, wherein the flexible member defines a length and a flexibility sufficient to allow the host connector to be inserted into the receptacle in the housing, wherein the receptacle comprises an electrical port for insertion of the host connector or insertion of another host connector of another device.

11. The data storage device of claim 10, wherein when the host connector of the other device is inserted into the electrical port and the host connector of the data storage device is inserted into the host computer, the host computer can supply power to the other device through the data storage device.

12. A data storage device comprising:

a housing formed with a receptacle;

one or more storage elements within the housing;

a host connector to facilitate attachment of the data storage device to a host computer so that the host computer can access the one or more storage elements, the host connector defining a size relative to the receptacle such that the host connector can fit into the receptacle in the housing;

a flexible member to mechanically couple the host connector to the housing, wherein the flexible member defines a length and a flexibility sufficient to allow the host connector to be inserted into the receptacle in the housing; and a light emitting diode within the housing to illuminate at least a portion of the housing, the portion of the housing illuminated by the light emitting diode being at least partially translucent, wherein the flexible member extends from a top surface of the housing and the receptacle is formed in the top surface such that the data storage device defines a padlock-like form factor, the device further comprising a locking mechanism to lock the host connector into the receptacle upon insertion of the host connector into the receptacle, wherein the locking mechanism is located between the receptacle and a mechanical junction of the flexible member and the housing, and wherein the light emitting diode illuminates an area of the housing around the locking mechanism.

13. A data storage device comprising:

a housing formed with a receptacle;

one or more storage elements within the housing;

a host connector facilitate attachment of the data storage device to a host computer so that the host computer access the one or more storage elements, the host connector defining a size relative to the receptacle such that the host connector can fit into the receptacle in the housing; and a flexible member to mechanically couple the host connector to the housing, wherein the flexible member defines a length and a flexibility sufficient to allow the host connector to be inserted into the receptacle in the housing, wherein the data storage device defines a ring-shaped form factor when the host connector is inserted into the receptacle in the housing and wherein the ring-shaped form factor is sized such that data storage device is wearable around a wrist of a user.

14. A data storage device comprising:

a housing formed with a receptacle;

one or more storage elements within the housing;

a host connector to facilitate attachment of the data storage device to a host computer so that the host computer can access the one or more storage elements, the host connector defining a size relative to the receptacle such that the host connector can fit into the receptacle in the housing; and a flexible member to mechanically couple the host connector to the housing, wherein the flexible member defines a length and a flexibility sufficient to allow the host connector to be inserted into the receptacle in the housing, wherein the data storage device defines a ring-shaped form factor when the host connector is inserted into the receptacle in the housing and wherein the ring-shaped form factor is sized such that data storage device is wearable around a neck of a user.

15. A data storage device comprising:

a housing formed with a receptacle;

one or more storage elements within the housing;

a controller within the housing to control access to the one or more storage elements;

a host connector to facilitate attachment of the data storage device to a host computer so that the host computer can access the one or more storage elements, the host connector defining a size relative to the receptacle such that the host connector can fit into the receptacle in the housing;

a flexible member to mechanically couple the host connector to the housing, wherein the flexible member defines a length and a flexibility such that the host connector can be inserted into the receptacle in the housing, wherein the flexible member extends from a top surface of the housing and the receptacle is formed in the top surface such that the data storage device defines a padlock-like form factor; and a locking mechanism to lock the host connector into the receptacle upon insertion of the host connector into the receptacle, wherein the locking mechanism is located between the receptacle and a mechanical junction of the flexible member and the housing.

* * * * *